United States Patent [19]

Balzer et al.

[11] 4,037,374

[45] July 26, 1977

[54] STAIR NOSING STRUCTURE

[75] Inventors: Claude P. Balzer; Almer A. Reiff; Edward M. Corman, all of Wichita, Kans.

[73] Assignee: Balco Inc., Wichita, Kans.

[21] Appl. No.: 686,741

[22] Filed: May 17, 1976

[51] Int. Cl.[2] ..... E04F 11/16; E04C 5/03

[52] U.S. Cl. ..... 52/179; 52/588

[58] Field of Search ..... 52/177, 179, 588

[56] References Cited

U.S. PATENT DOCUMENTS

| | | | |
|---|---|---|---|
| 893,198 | 7/1908 | Schachner | 52/179 |
| 2,016,918 | 10/1935 | Born | 52/511 |
| 3,421,274 | 1/1969 | Balzer et al. | 52/179 |
| 3,759,000 | 9/1973 | Balzer et al. | 52/179 |

*Primary Examiner*—James L. Ridgill, Jr.
*Attorney, Agent, or Firm*—Fishburn, Gold & Litman

[57] ABSTRACT

A stair nosing structure for a stair step having a tread surface and a riser or forwardly facing surface includes an elongated rigid base member having spaced portions defining at least one channel extending along the length thereof and an elongated tread member having elongated means extending therefrom and into the base member channel or channels with an interference engagement with spaced portions of the base member including at least one face of one of the base member channel defining portions to secure the tread member to the base member.

5 Claims, 6 Drawing Figures

STAIR NOSING STRUCTURE

The present invention relates to stair nosing structures for stair steps and more particularly to a stair nosing structure including an elongated rigid base member having spaced portions defining at least one channel extending longitudinally along the length thereof and an elongated tread member having elongated members extending therefrom and into the base member channel or channels with an interference engagement with spaced portions of the base member including at least one face of one of the base member channel defining portions to secure the tread member to the base member. Stair nosing structure of snap-on type or having interference fits for securing in place are shown and described in our co-pending application Ser. No. 646359 filed Jan. 2, 1976. The stair nosing structures in this application have similar purposes and some similarity in structure, but are of different forms and have different securing or mounting characteristics.

The principal objects of the present invention are: to provide a snap-on type stair nosing structure positively securing the nosing relative to a stair step yet having exposed components which can be removed and replaced when worn; to provide such a stair nosing structure having a base member and a tread member having members extending therefrom with interference engagement with spaced portions of the base member to secure the tread member on the base member; to provide such a stair nosing structure characterized by the absence of exposed fastening members, such as screws, bolts, and the like; to provide such a stair nosing structure wherein the tread member is retained on the base member in a manner to prevent relative lateral movement therebetween and separation in use; to provide such a stair nosing structure wherein friction between certain engaging portions of the tread member and the base member or interengaging portions on the engaging portions of the tread member and base member produces a strong stair nosing structure characterized by absence of separation or bounce in use; to provide such a stair nosing structure with portions of the base member defining at least one channel extending the length thereof and a tread member having elongated members extending therefrom and into said channel or channels with interference engagement to secure the tread member to the base member; to provide such a stair nosing structure in which the base member and tread member have cooperating surfaces or portions that hold the tread member in place; to provide such a stair nosing structure having cooperating portions on the tread and base members for guiding the tread member into seating engagement on the base member during mounting thereof; and to provide such a stair nosing structure which is economical to manufacture, is easily installed, forms an attractive and long lasting structure, and which is particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features of the stair nosing structure.

Figure 1:
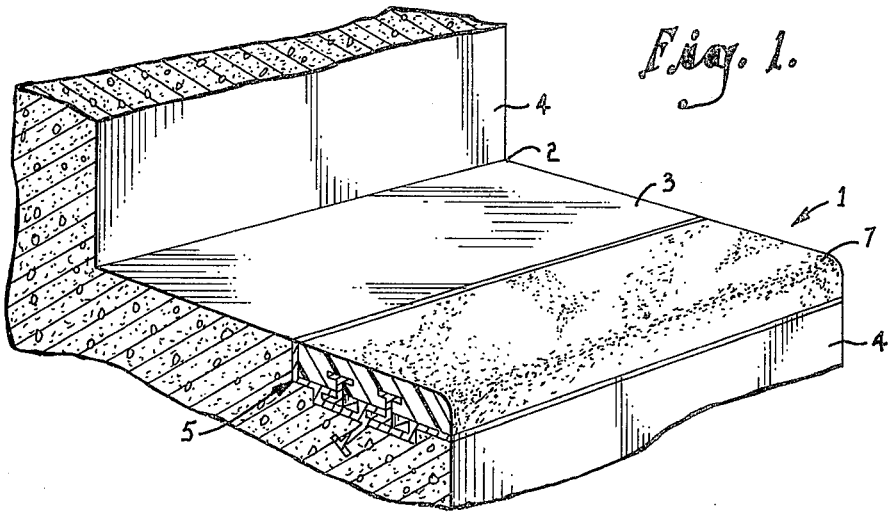
FIG. 1 is a partial perspective view of a stair nosing structure embodying features of the present invention and shown in place on a stair step with portions broken away to show the structure.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally a stair nosing structure for a stair step 2 having a tread surface 3 and a forwardly facing riser surface 4. The stair nosing structure 1 includes an elongated rigid base member 5 having spaced portions defining at least one channel 6 extending longitudinally along the length thereof and an elongated tread member 7 having elongated members or portions thereon which extend therefrom and into the channel 6 of the base member 5 with an interference engagement with spaced portions of the base member 5 including at least one face of one of the portions defining the base member channel 6 to secure the tread member 7 to the base member 5. The stair nosing structure 1 includes components particularly adapted to be formed of extrusions of metal, such as aluninum, brass, or other suitable metals.

Figure 2:
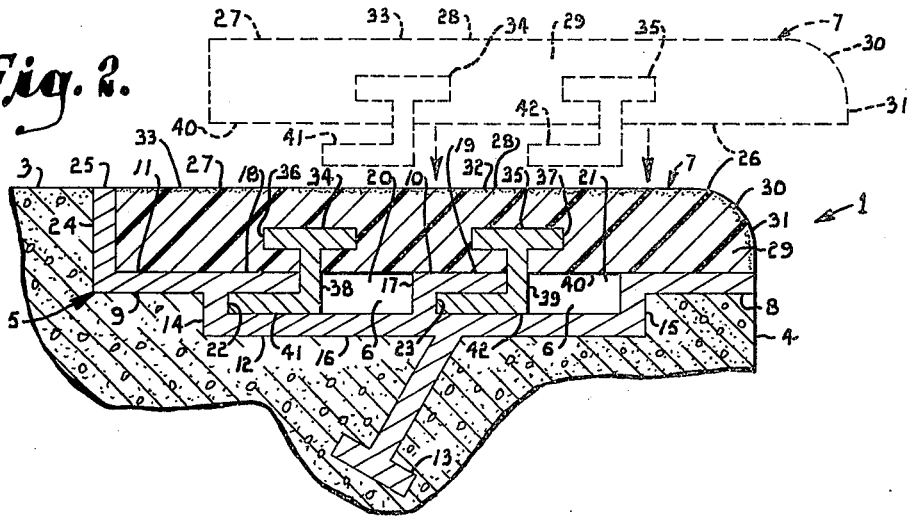
FIG. 2 is an enlarged transverse sectional view through the stair step and stair nosing structure with an initial position of a tread member for mounting thereof shown in broken lines.

In the structure illustrated in FIGS. 1 and 2, the base member 5 is an elongated relatively rigid structure adapted to be mounted on the stair step 2 adjacent the forwardly facing riser surface 4 thereof. The base member 5 has a forward edge portion 8 and a rear edge portion 9 with a body portion 10 extending therebetween. The body portion 10 has upwardly facing portions defining an upper face 11 and the body portion 10 has a lower face 12. The base member 5 has an anchor portion 13 extending from the body portion 10 and adapted to be secured to the stair step 2 during construction of the stair step 2. The base member 5 has portions defining at least one channel 6 which extends longitudinally along the length thereof and presents opposed faces extending from the upwardly facing portions of the body portion 10.

The illustrated base member 5 has a pair of channels 6 in side-by-side relation and formed in the body portion 10 of the base member 5. A pair of wall members 14 and 15 extend from the body portion 10 and are connected by a web portion 16 extending therebetween. The web portion 16 is substantially parallel with the upper surface 11. A rib 17 extends from the web portion 16 and is positioned intermediate the wall members 14 and 15 and terminates at the upper face 11 of the body portion 10. The body portion 10 includes flanges 18 and 19 extending from one of the wall members, for example, wall member 14, and from the rib 17 thereby defining channel entrance portions 20 and 21 through the body portion 10.

The pair of channels 6 have retaining portions 22 and 23 communicating with the entrance portions 20 and 21 respectively. The retaining portion 22 is defined by facing surfaces of the flange 18 and the web portion 16. The retaining portion 23 is defined by facing surfaces of the flange 19 and the web portion 16.

The rear edge portion 9 of the base member 5 includes a rear wall portion 24 extending substantially perpendicular to the body portion 10 and from a rear edge thereof. The rear wall portion 24 has an upper edge 25 adapted to be flush with or in registry with the tread surface 3 of the stair step 2. The forward edge portion 8 of the base member 5 is illustrated as a wall or flange portion extending beyond the other wall member 15 and terminating in a forward edge adapted to be flush with or in registry with the riser surface 4 of the stair step 2.

The tread member 7 of the stair nosing structure 1 is an elongated member having a forward edge portion 26, a rear edge portion 27, and a body portion 28 extending therebetween and overlying and engaging the body portion 10 of the base member 5. The tread member 7 may be formed of a single material, such as aluminum, brass or the like, however, it is preferred that the tread member 7 be of different materials, for example, metal portions to be received in the pair of base member channels 6 and a surface material 29 having the metal portions bonded therein and extending therefrom.

The surface material 29 includes a rounded nose 30 and a forward or front face 31 that is flush with or in registry with the forward edge of the flange portion defining the forward edge portion 8 of the base member 5 and the riser surface 4 of the stair step 2. The rounded nose 30 and the front face 31 define the forward edge portion 26 of the tread member 7. While any suitable surface material may be employed, it is preferred that the material be a long wearing material, such as an epoxy resin, with an abrasive 32 distributed therethrough, with some of the abrasive 32 exposed at an upper surface 33 thereby forming a non-skid surface.

The rear edge portion 27 of the tread member 7 is defined by a rearward facing surface engageable with a forwardly facing surface of the base member rear wall 24. The upper surface 33 of the tread member 7 is adapted to be flush with or in registry with the upper edge 25 of the base member rear wall portion 24 and with the tread surface 3 of the stair step 2.

The tread member 7 includes elongated members 34 and 35 extending from surface material 29 and engaging the base member 5 with an interference engagement with spaced portions of the base member 5 including at least one of the opposed faces of the channel defining portions of the base member 5 to secure the tread member 7 to the base member 5.

The elongated members 34 and 35 are bonded or formed within the tread member surface material 29. The illustrated elongated members 34 and 35 include top portions or flanges 36 and 37 respectively defining anchors within the surface material 29. Ribs or body portions 38 and 39 extend from the top flanges 36 and 37 respectively and extend outwardly from a lower surface 40 of the surface material 29 of the tread member 7. Lower or bottom flange 41 and 42 extend laterally from the ribs 38 and 39 respectively. The bottom flanges 41 and 42 are sized to pass or be moved through the entrance portions 20 and 21 respectively of the base member channels 6. The flanges 41 and 42 are received in the retaining portions 22 and 23 respectively. The flange 41 has opposite faces thereof in engagement with the flange 18 and the web portion 16 respectively and the flange 42 has opposite faces thereof in engagement with the flange 19 and the web portion 16 respectively thereby defining the interference engagement of the elongated members 34 and 35 with the base member channel defining portions.

To assure a positive lock of the elongated members 34 and 35 within the respective retaining portions 22 and 23, interengaging teeth may be formed on one of the opposed faces of the base member channel defining portions and on the respective face of the respective bottom flange of the elongated members 34 and 35 to thereby cooperate in securing the tread member 7 to the base member 5.

Figure 3:
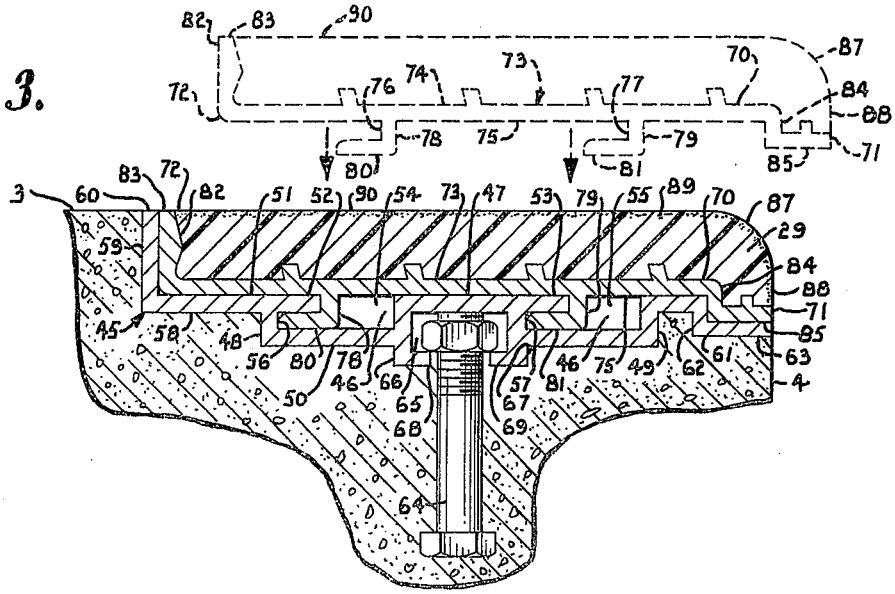
FIG. 3 is an enlarged transverse sectional view through the stair step and through a first modified stair nosing structure with an initial position of a first modified tread member for mounting thereof shown in broken lines.

FIG. 3 illustrates a first modified form of the stair nosing structure wherein a base member 45 is substantially similar to the base member 5 illustrated in FIGS. 1 and 2. The base member 45 illustrated in FIG. 3 has a pair of channels 46 in side-by-side relation and formed in a body portion 47 of the base member 45. The base member channels 46 are similar to the base member channels 6 illustrated in FIGS. 1 and 2. A pair of wall members 48 and 49 extend from the body portion 47 and are connected by a web portion 50. The illustrated web portion 50 is substantially parallel to an upper face or surface 51 of the body portion 47. Flange 52 and 53 are part of the body portion 47 and are similar to the flanges 18 and 19 illustrated in FIGS. 1 and 2 thereby defining channel entrance portions 54 and 55 through the body portion 47. The pair of channels 46 have retaining portions 56 and 57 communicating with the entrance portions 54 and 55 respectively.

A rear edge portion 58 of the base member 45 includes a rear wall portion 59 extending substantially perpendicular to the body portion 47 and from a rear edge thereof. The rear wall portion 59 has an upper edge 60 adapted to be flush with or in registry with the tread surface 3 of the stair step 2.

A forward edge portion 61 of the base member 45 includes a wall portion 62 extending from the body portion 47 and substantially perpendicular to the body portion 47. The forward edge portion 61 includes a flange portion 63 extending from the wall portion 62 and terminating in a forward edge adapted to be flush with or in registry with the riser surface 4 of the stair 2.

The base member 45 may be anchored to the stair step 2 by an anchor portion similar to the anchor portion 13 illustrated in FIGS. 1 or 2 or by a plurality of anchor members 64 supported in a guide way 65. In the illustrated embodiment, wall members 66 and 67 extend between the body portion 47 and the web portion 50 of the base member 45. Facing flanges 68 and 69 extend from the wall members 66 and 67 and from a reduced opening and define shoulders for supporting the anchor members 64.

The first modified stair nosing structure illustrated in FIG. 3 includes a tread member 70 which is an elongated member having a forward edge portion 71 and a rear edge portion 72 with a body portion 73 extending therebetween and overlying the body portion 47 of the base member 45. The body portion 73 of the tread member 70 has an upper face 74 and a lower face 75 adapted for engaging the upwardly facing portions of the base member 45.

The tread member 70 has elongated portions 76 and 77 extending from the body portion 73 and into the base member channels 46 with interference engagement with spaced portions of the base member 45 in a manner similar to the interference engagement of the elongated members 34 and 35 within the channels 6 of the base member 5 illustrated in FIGS. 1 and 2.

In the embodiment illustrated in FIG. 3, ribs 78 and 79 extend from the body portion 73 and extend outwardly from the lower face 75 of the tread member 7. Flanges 80 and 81 extend laterally from the ribs 78 and 79 respectively. The flanges 80 and 81 are sized to pass or be moved through the entrance portions 54 and 55 respectively of the base member channels 46. The flanges 80 and 81 are received in the retaining portions 56 and 57 respectively of the base member 45. The flange 80 and opposite faces thereof in engagement with the flange 52 and the web portion 50 respectively of the base member 45 and the flange 81 has opposite faces thereof in engagement with the flange 53 and the web portion 50 respectively thereby defining the interference engagement of the elongated portions 76 and 77 with the base member channel defining portions.

To assure a positive lock of the elongated portions 76 and 77 within the retaining portions 56 and 57 interengaging teeth may be formed on one of the opposed faces of the base member channel defining portions and on the respective face of the flanges 80 and 81 of the elongated portions 76 and 77 to thereby cooperate in securing the tread member 70 to the base member 45.

The rear edge portion 72 of the tread member 70 includes a rear wall portion 82 extending substantially perpendicular to the tread member body portion 73 and from a rear edge thereof. The rear wall portion 82 has an upper edge 83 adapted to be flush with or in registry with the upper edge 60 of the rear wall portion 59 of the base member 45.

The forward edge portion 71 of the tread member 70 includes a wall portion 84 extending from the body portion 73 and substantially perpendicular to the body portion 73. The wall portion 84 has a rearwardly facing surface engageable with the forwardly facing surface of the wall portion 62 of the forward edge portion 61 of the base member 45. The forward edge portion 71 of the tread member 70 includes a flange 85 extending from the wall portion 84 and terminating in a forward edge adapted to be flush with or in registry with the forward edge of the flange portion 63 of the base member forward edge portion 61.

The illustrated tread member 70 includes surface material 86 bonded to a metal portion including the previously described walls and portions. The surface material 86 includes a rounded nose 87 and a forward face 88 that is flush with or in registry with the forward edge of the flange portion 85 of the tread member forward edge portion 71. The surface material 86 is preferably similar to the material described for the tread member 7 illustrated in FIGS. 1 and 2 and includes an abrasive 89 distributed throughout the surface material 86 with some of the abrasive 89 being exposed at an upper surface 90 thereby forming a non-skid surface.

Figure 4:
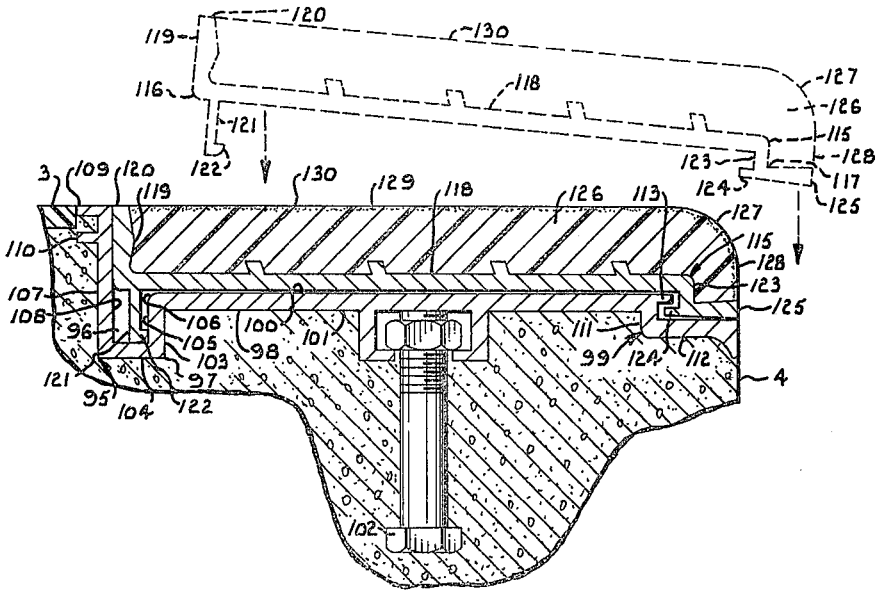
FIG. 4 is an enlarged transverse sectional view through the stair step and through a second modified stair nosing structure with an initial position of a second modified tread member for mounting thereof shown in broken lines.

FIG. 4 illustrates a second modified form of the stair nosing structure wherein a base member 95 has a channel 96 adjacent and defining a rear edge portion 97 of the base member 95. The base member 95 has a body portion 98 extending from the rear edge portion 97 and connected to a forward edge portion 99 of the base member 95. The body portion 98 has upwardly facing portions defining an upper face 100 and the body portion 98 has a lower face 101. The base member 95 has anchor means 102 adapted to be secured to the stair step 2. The anchor means 102 are substantially similar to the anchor means illustrated in FIG. 3.

The channel 96 extends longitudinally along the length of the base member 5 and presents opposed faces extending from the upwardly facing portions of the body portion 98. The illustrated portions defining the channel 96 includes a first wall member 103 depending from the body portion 98 and connected to a lower body portion or end wall 104. The first channel defining wall member 103 has an exposed face or surface 105 with an upper portion 106 thereof inclined downwardly and rearwardly from the upper face 100 of the body portion 98. The channel defining portions include a second or rear wall member 107 extending upwardly from rear edge of the end wall 104 and having the upper edge thereof adapted to be flush with or in registry with the surfacing material of the tread surface 3 of the stair step 2. The first and second channel defining wall members 103 and 107 are in opposed facing relation and the rear wall member 107 has an exposed forwardly facing surface 108.

A rearwardly facing surface of the rear wall member 107 has means thereon to receive and form a border for surfacing material, such as asphalt tile, vinyl tile, vinyl asbestos, tile or other suitable surfacing material on the tread surface 3 of the stair 2. Flange portions 109 and 110 extend from a rearwardly facing surface of the rear wall member 107 and define a rearwardly open channel extending from the rear wall 107 for the length of the base member 95. The flange portions 109 and 110 are adapted to receive therein an edge portion of the surfacing material.

The forward edge portion 99 of the base member 55 includes portions defining a forwardly open channel extending for the length of the base member, for a purpose latter described. The forwardly open channel includes a wall member 111 depending from the body portion 98 and substantially perpendicular to the body portion 98. The forward edge portion 99 includes a flange 112 extending forwardly from the lower end of the wall member 111 and terminating in a forward edge adapted to be flush with or in registry with the riser surface 4 of the stair 2. The forward edge of the flange 112 may be enlarged to provide a border for facing material on the riser surface 4 of the stair step 2.

a rib 113 extends forwardly from a forward edge of the body portion 98 and extends beyond the wall member 111. The rib 113 is substantially parallel with and spaced from the flange 112 whereby the rib 113, wall member 111, and flange 112 define the forwardly open channel. The rib 113 has a free edge spaced from the riser surface 4 of the stair step 2.

The stair nosing structure illustrated in FIG. 4 includes a tread member 115 in the form of an elongated member having a rear edge portion 116 and a forward edge portion 117 with a body portion 118 extending therebetween and overlying the body portion 98 of the base member 95.

The tread member 115 has elongated means thereon which extend from the tread member 115 and into the base member channel 96 with an interference engagement with spaced portions of the base member 95 including one of the first wall member 103 and the second or rear wall member 107 to clamp the tread member 115 to the base member 95.

In the embodiment of the stair nosing structure illustrated in FIG. 4, the trend member 115 has a rear wall member 119 with an upper edge 120 thereof adapted to be flush with or in registry with the upper edge of the rear wall member 107 of the base member 95 and with the upper surface of the upper of the flanges 109 and 110. The tread member rear wall member 109 has a rearwardly facing surface adapted to be in engagement with the forwardly facing surface 108 of the base member rear wall 107.

The tread member rear edge portion 116 includes a resilient wall member or lever member 121 extending from the tread member body portion 118 and in engagement with the first wall member 103 of the base member channel defining portions for urging the tread member 115 into clamping engagement with the upwardly facing portions of the base member 95.

The illustrated resilient wall member or lever member 121 includes an enlarged end portion 122 in engagement with the exposed face 105 of the first wall member 103 of the base member 95. The enlarged end portion 122 of the lever member 121 moves across the upper portion 106 and along the exposed face 105 of the base member first wall 103 until the enlarged end portion 122 engages the end wall or lower body portion 104 of the base member channel defining portions to thereby support the tread member 115 of the base member 95.

The tread member forward edge portion 117 includes portions engageable with the base member forward edge portion 99 to retain the tread member rear wall 119 in engagement with the base member rear wall 107 and the tread member lever member 121 in engagement with the base member first wall member 103 and the end wall member 104. The illustrated tread member forward edge portion 117 includes portions defining a rearwardly open channel extending for the length of the tread member 115. The rearwardly open channel includes a wall member 123 depending from and substantially perpendicular to the tread member body portion 118. The tread member forward edge portion 117 includes a flange extending from the lower end of the wall member 123 and having a rearwardly extending portion 124 adapted to be received in the forwardly open channel of the base member forward edge portion 99. The rearwardly extending portion 124 of the flange extending from the lower end of the wall member 123 is received in the forwardly open channel of the base member forward edge portion 99 and positioned between the flange 112 and the rib 113. The flange extending from the lower end of the wall member 123 has a forwardly extending portion 125 having a forward edge adapted to be flush with or in registry with the riser surface 4 of the stair step 2 and with the forward edge of the base member flange 112.

The tread member 115 includes surface material 126 bonded to a metal portion including the previously described walls end portions. The surface material 126 includes a rounded nose 127 and a forward face 128 that is flush with or in registry with the forward edge of the forwardly extending flange portion 125 of the tread member forward edge portion 117. The surface material 126 is preferably similar to the material described for the tread members 7 and 70 illustrated in FIGS. 1 to 3 inclusively. The surface material 126 includes an abrasive material 129 distributed through the surface material 126 with some of the abrasive 129 exposed at an upper surface 130 thereby forming a non-skid surface.

Figure 5:
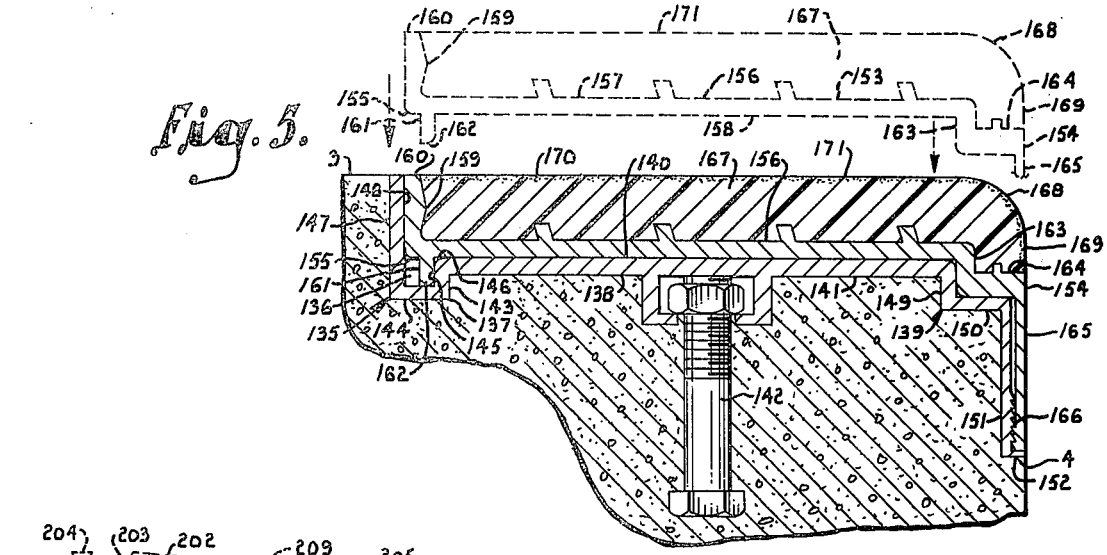
FIG. 5 is an enlarged transverse sectional view through the stair step and through a third modified stair nosing structure with an initial position of a third modified tread member for mounting thereof shown in broken lines.

FIG. 5 illustrates a third modified form of the stair nosing structure wherein a base member 135 has a channel 136 adjacent and defining a rear edge portion 137 of the base member 135. The base member 135 has a body portion 138 extending from the rear edge portion 137 and connected to a forward edge portion 139 of the base member 135. The body portion 138 has upwardly facing portions defining an upper face 140 and the body portion 138 has a lower face 141. The base member 135 has anchor means 142 adapted to be secured to the stair step 2. The anchor means 142 are substantially similar to the anchor means illustrated in FIGS. 3 and 4.

The channel 136 extends longitudinally along the length of the base member 135 and presents opposed faces extending from the upwardly facing portions of the body portion 138. The illustrated portions defining the channel 136 include a first wall member 143 depending from the body portion 138 and connected to a lower body portion or end wall 144. The first channel defining wall member 143 has an exposed face or surface 145 with an upper portion 146 thereof inclined downwardly and rearwardly from the upper face 140 of the body portion 138. The channel defining portions of the base member 135 include a second or rear wall member 147 extending upwardly from the rear edge of the end wall 144 and having an upper edge adapted to be flush with or in registry with the tread surface 3 of the stair step 2. The first and second channel defining wall members 143 and 147 are in opposed facing relation and the rear wall member 147 has an exposed forwardly facing surface 148.

The forward edge portion 139 of the base member 135 includes a first wall portion 149 extending from the body portion 138 and substantially perpendicular to the body portion 138. The forward edge portion 139 includes a second wall portion 150 extending from the first wall portion 149 and substantially perpendicular to the first wall portion 149. The second wall portion 150 is substantially parallel with the body portion 138. A third wall portion 151 extends from the second wall portion 150 and is substantially parallel with the first wall portion 149. The third wall portion 151 has a forwardly facing surface spaced rearwardly from the riser surface 4 of the stair step 2. The third wall portion 151 includes an end flange 152 extending from the lower end of the third wall portion 151 and terminating in a forward edge adapted to be flush with or in registry with the riser surface 4 of the stair step 2.

The third modified form of the stair nosing structure illustrated in FIG. 5 includes a tread member 153 which is an elongated member having a forward edge portion 154 and a rear edge portion 155 with a body portion 156 extending therebetween and overlying the body portion 138 of the base member 135. The tread member body portion 156 has an upper face 157 and a lower face 158 adapted to be in engagement with the upwardly facing portions of the base member 135.

The tread member 153 has elongated means thereon which extend therefrom and into the base member channel 136 with an interference engagement with spaced portions of the base member 135 including one of the first wall members 143 and the second or rear wall member 147 to clamp the tread member 153 to the base member 135.

In the embodiment illustrated in FIG. 5, the tread member 153 has a rear wall member 159 with an upper edge 160 thereof adapted to be flush with or in registry with the upper edge of the rear wall member 147 of the base member 135 and with the tread surface 3 of the stair step 2. The tread member rear wall member 159 has a rearwardly facing surface adapted to be in engagement with the forwardly facing surface 148 of the base member rear wall member 147.

The tread member rear edge portion 155 includes a resilient wall member or lever member 161 extending from the tread member body portion 156 and in engagement with the first wall member 143 of the base member channel defining portions for urging the tread member 153 into clamping engagement with the upwardly facing portion of the base member 135.

The illustrated resilient wall member or lever member 161 has a lower end portion 162 rounded so that the resilient wall member 161 may be moved over the upper portion 146 of the first wall member 143 of the base member channel defining portions during mounting of the tread member 153 on the base member 135.

The tread member forward edge portion 154 includes portions engageable with the base member forward edge portion 139 to retain the tread member rear wall 159 in engagement with the base member rear wall member 147 and the tread member lever member 161 in engagement with the base member first wall member 143.

The illustrated forward edge portion 154 of the tread member 153 includes a first wall portion 163 extending from the body portion 156 and substantially perpendicular to the body portion 156. The forward edge portion 154 includes a second wall portion 164 extending from the first wall portion 163 and substantially perpendicular to the first wall portion 163. The second wall portion 164 is substantially parallel with and spaced from the body portion 156 of the tread member 153. A third wall portion 165 extends from the second wall portion 164 and is substantially parallel with the first wall portion 163.

The third wall portion 165 has a rearwardly facing surface adapted to be in overlying relation with the third wall portion 151 of the base member forward edge portion 139. The tread member third wall portion 165 has a lower end in engagement with the end flange 152 of the base member third wall portion 151 when the tread member 153 is mounted on the base member 135. The tread member first wall portion 163 is overlying and in engagement with the base member first wall portion 149 and the tread member second wall portion 164 is overyling and in engagement with the base member second wall portion 150 when the tread member 153 is mounted on the base member 135.

The stair nosing structure illustrated in FIG. 5 may also include means to retain the tread member 153 in position on the base member 135. In the illustrated embodiment, interengaging teeth 166 are formed on the forwardly facing surface of the base member third wall portion 151 and on the rearwardly facing surface of the tread member third wall portion 165 and cooperate to retain the tread member 153 on the base member 135.

The tread member 153 includes surface material 167 bonded to a metal portion including the previously described walls and portions. The surface material 167 includes a rounded nose 168 and a forward face 169 that is flush with or in registry with the forward face 169 that is flush with or in registry with the forward face or surface of the third wall portion 165 of the tread member forward edge portion 154. The surface material 167 is preferably similar to the material described for the tread member 7, 70, and 115 illustrated in FIGS. 1–4 inclusive. The surface material 167 includes an abrasive material 170 distributed throughout the surface material 167 with some of the abrasive material 170 exposed at an upper surface 171 thereby forming a non-skid surface.

Figure 6:
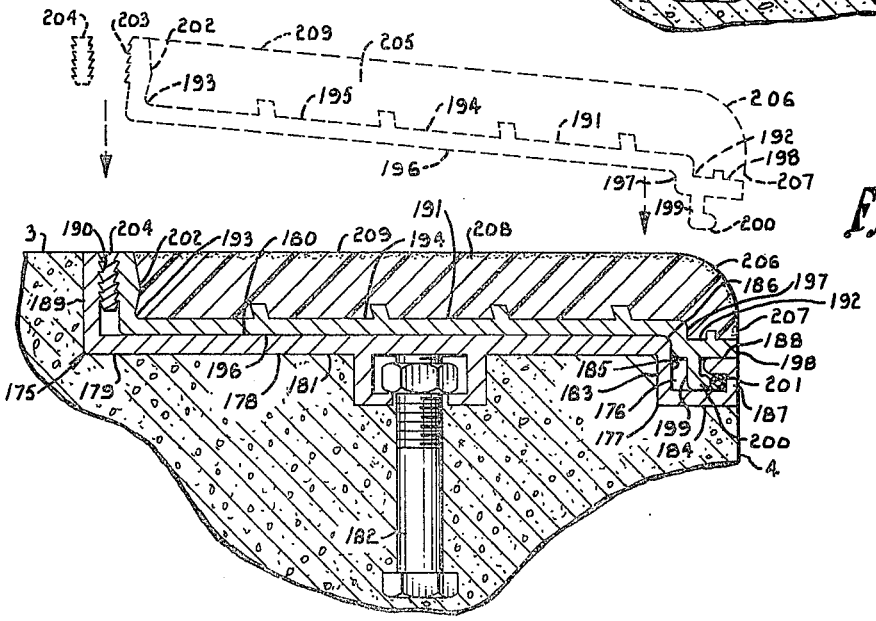
FIG. 6 is an enlarged transverse sectional view through the stair step and through a fourth modified stair nosing structure with an initial position of a fourth modified tread member for mounting thereof shown in broken lines.

FIG. 6 illustrates a fourth modified form of the stair nosing structure wherein a base member 175 has a channel 176 adjacent and defining a forward edge portion 177. The base member 175 has a body portion 178 extending from the forward edge portion 177 and connected to a rear edge portion 179. The body portion 178 has upwardly facing portions defining an upper face 180 and the body portion 178 has a lower face 181. The base member 175 has suitable anchor means 182 adapted to be secured to the stair step 2. The anchor means 182 are substantially similar to the anchor means illustrated in FIGS. 3, 4, and 5.

The channel 176 extends longitudinally along the length of the base member 175 and presents opposed faces extending from the upwardly facing portions of the body portion 178. The illustrated portions defining the channel 176 include a first wall member 183 depending from the body portion 178 and connected to a lower body portion or wall 184 extending forwardly from the first wall member 183 and substantially normal thereto. The first channel defining wall member 183 has an exposed face or surface 185 with an upper portion 186 thereof rounded or inclined downwardly and forwardly from the upper face 180 of the body portion 178. The channel defining portions of the base member 175 includes a second or forward wall member 187 extending upwardly from a forward edge of the end wall 184 and having a forward surface thereof adapted to be flush with or in registry with the riser surface 4 of the stair step 2.

A flange 88 extends from an upper edge of the forward wall member 187 and extends toward the first wall member 183. The flange 188 is positioned below the body portion 178 and above the lower body portion 184. The flange 183 has a free edge thereof spaced from and in facing relation with the exposed face 185 of the first wall member 183 thereby defining an entrance portion to the base member channel 176. The flange 188 is spaced above and substantially parallel with the end wall or lower body portion 184 thereby defining a retaining portion for the base member channel 176 and which communicates with the entrance portion of the channel 176. The free edge of the flange 188 is rounded, for a purpose later described.

The rear edge portion 179 of the base member 175 includes a wall member 189 extending upwardly from a rear edge of the body portion 178. The rear wall member 189 has an upper edge adapted to be flush with or in registry with the tread surface 3 of the stair step 2. The rear wall member 189 has a forwardly facing surface having a plurality of teeth 190 thereon, for a purpose later described.

The fourth modified form of the stair nosing structure illustrated in FIG. 6 includes a tread member 191 which is an elongated member having a forward edge portion 192 and a rear edge portion 193 with a body portion 194 extending therebetween and overlying the body portion 178 of the base member 175. The tread member body portion 194 has an upper face 195 and a lower face 196 adapted to be in engagement with the upwardly facing portion of the base member 175.

The tread member forward edge portion 192 includes means cooperating with the base member forward edge portion 177 and effective to position the tread member 192 in covering relation with the upwardly facing portions of the base member 175.

In the embodiment illustrated in FIG. 6, the tread member forward edge portion 192 includes a wall member 197 depending from and substantially perpendicular to the tread member body portion 194. The wall member 197 has a rearwardly facing surface engageable with a forwardly facing surface 185 of the first wall member 183 of the base member forward edge portion 177 thereby laterally positioning the tread member 191 relative to the base member 175. A flange 198 extends from the lower end of the wall member 197 and is substantially perpendicular to the wall member 197 and substantially parallel with the tread member body portion 194. The flange 198 has a free edge thereof adapted to be flush with or in registry with the forward surface of the base member forward wall 187 and with the riser surface 4 of the stair step 2 when the tread member 191 is mounted on the base member 175. The flange 198 is in engagement with an upper surface of the flange 188 of the base member forward edge portion 177 when the tread member 191 is mounted on the base member 175.

The tread member forward edge portion 192 includes a rib 199 depending from the flange 198 and positioned intermediate the wall member 197 and the forward edge of the flange 198. The rib 199 is received in the entrance portion of the base member channel 176. A lower flange 200 extends forwardly from the lower end of the rib 199 and is received in the retaining portion of the base member channel 176. The free edge of the lower flange 200 is rounded so that the lower flange 200 may move around the rounded free edge of the flange 198 of the base member forward edge portion 177 during mounting of the tread member 191 on the base member 175. The lower flange 200 includes opposite faces each in engagement with a respective one of the opposed faces of the base member channel defining portions.

An elongated compressible member 201 is positioning in the retaining portion of the base member channel 176 and is engageable by the free edge of the lower flange 200 when the tread member body portion 194 is in engagement with the base member body portion 178 and the wall member 197 of the tread member forward edge portion 192 is in engagement with the exposed face 185 of the first wall member 183 of the base member channel defining portions.

The rear edge portion 193 of the tread member 191 includes a rear wall member 202 extending upwardly from a rear edge of the body portion 194 and having an upper edge thereof adapted to be flush with or in registry with the upper edge of the rear wall member 189 of the base member rear edge portion 179. The rear wall member 202 of the tread member 191 has a rearwardly facing surface having a plurality of teeth 203 thereon in facing relation with the teeth 190 on the forwardly facing surface of the base member rear wall member 189.

The tread member rear wall member 202 is spaced from the base member rear wall member 189 so that an elongated wedge member 204 may be moved into the space between facing surfaces of the base member and tread member rear wall members 189 and 202 respectively for retaining the tread member rear edge portion 193 in engagement with the base member rear edge portion 179. In the illustrated embodiment, the wedge member 202 has opposite faces each with a plurality of teeth thereon and adapted to interengage with the teeth 190 and 203 on the rear wall members 189 and 202 of the base member rear edge portion 179 and the tread member rear edge portion 193 respectively.

The tread member 191 includes surface material 205 bonded to a metal portion including the previously described walls and portions. The surface material 205 includes a rounded nose 206 and a forward face 207 that is flush with or in registry with the forward edge of the flange 198 of the tread member forward edge portion 192. The surface material 205 is preferably similar to the material described for the tread members 7, 70, 115, and 153 illustrated in FIGS. 1 to 5 inclusive. The surface material 205 preferably includes an abrasive material 208 distributed throughout the surface material 205 with some of the abrasive material 208 exposed at an upper surface 209 thereby forming a non-skid surface.

It is to be understood that while we have illustrated and described certain forms of our invention, it is not to be limited to these specific forms or arrangement of parts herein described and shown.

What we claim and desire to secure by Letters Patent is:

1. A stair nosing structure for a stair step having a tread surface, said stair nosing structure comprising:

a. an elongated relatively rigid base member for mounting on a stair step, said base member having a forward edge portion and a rear edge portion and upwardly facing portions, said base member having an anchor portion for securing said base member to the stair step, said base member having portions defining a channel extending along the length thereof and presenting opposite substantially parallel faces, said base member channel defining portions including wall members extending from said base member adjacent the rear edge portion thereof;

b. an elongated tread member having a forward edge portion and a rear edge portion and overlying said base member, said tread member having portions engaging said upwardly facing portions of said base member;

c. elongated means extending from said tread member and engaging said base member with an interference engagement with spaced portions of said base member including at least one of said opposed faces of said channel defining portions of said base member to secure said tread member to said base member, said elongated means extending from said tread member including:

1. a first wall member at a rear edge portion of said tread member and having a face engageable with a face of one wall member of said base member channel defining portions; and
2. a second wall member spaced forwardly from said first wall member and extending from said tread member and engageable with the opposed face of the other of said wall members of said base member channel defining portions, said second wall member of said tread member being resilient to urge said face of the tread member first wall member into clamping engagement with said face of the wall member of said base member channel defining portions.

2. A stair nosing structure as set forth in claim 1 including interengaging means on said base member forward edge portion and on said tread member forward edge portion and providing a force opposing force applied from engagement of said second wall member of said tread member with said other wall member of said base member channel defining portions to retain said tread member seated on said base member.

3. A stair nosing structure as set forth in claim 2 wherein:

a. said base member includes a body portion extending between said forward edge portion and said rear edge portion;

b. said base member forward edge portion includes a first wall member extending laterally from said base member body portion and a second wall member extending laterally from said first wall member and a third wall member extending laterally from said second wall member and having a forwardly facing surface;

c. said tread member includes a body portion extending between said forward edge portion and said rear edge portion; and d. said tread member forward edge portion includes a first wall member extending laterally from said tread member body portion and a second wall member extending laterally from said first wall member and a third wall member extending laterally from said second wall member and having a rearwardly facing surface in facing relation with and in engagement with said forwardly facing surface of said third wall member of said base member forward edge portion.

4. A stair nosing structure for a stair step having a tread surface, said stair nosing structure comprising:

a. an elongated relatively rigid base member for mounting on a stair step, said base member having a forward edge portion and a rear edge portion and upwardly facing portions, said base member including a body portion extending between said forward edge portion and said rear edge portion, said base member having an anchor portion for securing said base member to the stair step, said base member having portions defining at least one channel extending along the length thereof and presenting opposed faces;

b. said base member channel defining portions are positioned intermediate said base member forward edge portion and said base member rear edge portion and extend from said base member body portion and define an entrance portion and a retaining portion parallel to said upwardly facing portions of said base member;

c. an elongated tread member having a forward edge portion and a rear edge portion and overlying said base member, said tread member having portions engaging said upwardly facing portions of said base member;

d. elongated means extending from said tread member and engaging said base member with an interference engagement with spaced portions of said base member including at least one of said opposed faces of said channel defining portions of said base member to secure said tread member to said base member, said elongated means including a rib for each base member channel and a flange extending from said rib and received in the retaining portion of said respective base member channel; and e. said flange of said elongated means extending from said tread member to secure said tread member to said base member includes opposite faces each in engagement with a respective one of said opposed faces of said respective base member channel defining portions.

5. A stair nosing structure as set forth in claim 4 including:

a. means on said base member rear edge portion defining an upwardly extending wall having a forwardly facing surface; and b. means on said tread member rear edge portion defining an upwardly extending wall having a rearwardly facing surface engageable with said forwardly facing surface of said base member rear edge portion when said flange of said elongated means extending from said tread member is seated in said respective base member channel.

* * * * *